US005469245A

United States Patent [19]

Aoshima et al.

[11] Patent Number: 5,469,245

[45] Date of Patent: Nov. 21, 1995

[54] DEVELOPMENT METHOD AND APPARATUS AND MULTICOLOR IMAGE FORMING APPARATUS USING THESE

[75] Inventors: Taku Aoshima; Tsuneo Noami; Hiroh Soga; Takeshi Sumikawa; Nobumasa Furuya; Tadakazu Edure, all of Ebina, Japan

[73] Assignee: Fuji Xerox Co., Ltd., Tokyo, Japan

[21] Appl. No.: 121,238

[22] Filed: Sep. 13, 1993

[30] Foreign Application Priority Data

| | | | |
|---|---|---|---|
| Sep. 14, 1992 | [JP] | Japan | 4-269125 |
| Mar. 16, 1993 | [JP] | Japan | 5-081243 |
| Aug. 25, 1993 | [JP] | Japan | 5-232417 |

[51] Int. Cl.[6] ..... G03G 15/09

[52] U.S. Cl. ..... 355/251; 118/657; 355/245

[58] Field of Search ..... 355/77, 326 R, 355/327, 245, 251, 253; 118/656, 657, 658

[56] References Cited

U.S. PATENT DOCUMENTS

| | | | |
|---|---|---|---|
| 4,308,821 | 1/1982 | Matsumoto et al. | 118/658 X |
| 4,334,772 | 6/1982 | Suzuki | 118/657 X |
| 4,350,440 | 9/1982 | Watanabe | 118/657 X |
| 4,637,706 | 1/1987 | Hosoi et al. . | |
| 4,841,332 | 6/1989 | Haneda et al. | 355/251 |
| 4,844,008 | 7/1989 | Sakemi et al. | 355/658 |
| 4,911,100 | 3/1990 | Yamashita | 118/658 |
| 5,212,525 | 5/1993 | Noami et al. | 355/251 |
| 5,296,328 | 3/1994 | Fuji et al. | 355/251 |

FOREIGN PATENT DOCUMENTS

| | | |
|---|---|---|
| 56-144452 | 11/1981 | Japan . |
| 60-176069 | 9/1985 | Japan . |

*Primary Examiner*—Sandra L. Brase

*Attorney, Agent, or Firm*—Finnegan, Henderson, Farabow, Garrett & Dunner

[57] ABSTRACT

The development apparatus of this invention includes a developer supporting body consisting of a rotatable non-magnetic sleeve and a magnet roll fixedly installed within the rotatable non-magnetic sleeve. The development method involves the following steps: a latent image formed on a latent image supporting body is developed or made visible with a two-component developer carried on the developer supporting body in a non-contact manner; a horizontal magnetic field which is orientated in the circumferential direction of the developer supporting body is applied to the developer in an effective development area on the developer supporting body, the effective development area facing the latent image supporting body; and a developer movement promotion magnetic field is applied locally to a part of the effective development area on the developer supporting body so that the developer is expelled from that part of the effective development area and that chains of carrier of the developer in the developer expelled region are slid in the circumferential direction of the developer supporting body. This development method ensures a sufficiently high development performance during the multicolor image forming process without disturbing the toner image formed.

12 Claims, 14 Drawing Sheets

DEVELOPMENT METHOD AND APPARATUS AND MULTICOLOR IMAGE FORMING APPARATUS USING THESE

FIELD OF THE INVENTION

The present invention relates to a development method and apparatus used in image forming apparatuses, such as electronic photocopying machines or printers, that form monocolor or multicolor images. More particularly, this invention relates to improvements in the development method and apparatus and also to a multicolor image forming apparatus using these, in which a thin layer of magnetic brush is formed on a developer supporting body to develop or make visible a latent image formed on a latent image supporting body in a non-contact manner.

BACKGROUND OF THE INVENTION

For conventional copying machines in which an electrostatic latent image formed on a photosensitive body is developed by a development apparatus and then transferred onto recording paper, many development techniques have been proposed which employ a two-component magnetic brush that brings developer into contact with the surface of the photosensitive body to make the electrostatic latent image visible. This method has become the mainstream because of its good picture quality and picture quality retaining capability although it has a drawback of making the toner density control complex and increasing the size of the apparatus.

As an increasing number of copying machines have begun introducing higher image quality and multicolor recording in recent years, multicolor image forming processes are being proposed in which two or more color-toner images are formed simultaneously on the photosensitive body and then transferred onto recording paper at a time. If the above-mentioned contact-type two-component magnetic brush development method is applied to the second or later development stage during the multicolor image formation, various technical problems arise, i.e. toner images already formed on the photosensitive body are destroyed, color-toners other than the selected one are mixed, or other color-toners enter into the development apparatuses.

To solve these problems, a number of so-called non-contact development techniques have been proposed to develop latent images without bringing the developer into contact with the surface of the photosensitive body.

Among such non-contact development methods is Japanese Patent Laid-Open No. 144452/1981, in which a thin layer of developer made up of toner and magnetic carrier (i.e. development magnetic brush) is formed on the development roll and, with the photosensitive body and the development magnetic brush kept out of contact, disturbing effects are produced in the developer layer by a magnetic, electrical or-mechanical means to develop the image.

This method allows the development stages located behind the first toner image in the multicolor image forming process to form quality images with no disturbance that would otherwise result from mechanical contact of the magnetic brush and with no mixing of colors.

As disclosed in Japanese Patent Laid-Open No. 176069/1985 in particular, magnetic poles are installed in the magnet roll at positions away from the point where the development sleeve is closest to the photosensitive body, and a horizontal magnetic field is applied to the developer layer which is also subjected to a vibrating electric field for development. This method assures formation of a thin, uniform layer of developer, which in turn enables quality images to be formed by development stages located behind the first toner image in the multicolor image forming process.

These development methods can not only be applied to the multicolor image forming process but also be used as monocolor recording development techniques. Since the magnetic brush is out of contact with the latent image on the photosensitive body, an input image can be expected to be reproduced precisely.

Although a thin and uniform developer layer can be obtained by the action of the horizontal magnetic field, the development method proposed by Japanese Patent Laid-Open No. 176069/1985, however, has a drawback of deteriorated development performance. That is, in the multicolor image forming process,to prevent a toner image already formed on the photosensitive body from being disturbed, the development performance for the current image being developed cannot be enhanced to a sufficient degree.

In an effort to resolve the above problem of deteriorated development performance in the non-contact development process, a variety of studies have been made on the development method in which the development magnetic poles are located away from the position where the sleeve is closest to the photosensitive body to apply a horizontal magnetic field to the developer layer during the development process.

Our studies have found that when a horizontal magnetic field is applied, the developer particles are magnetically aligned along magnetic lines of force forming concentrated, uniform thin layers of developer over the surface of the development sleeve. It is, however, found that only one or two top developer layers contribute to the development.

This is considered due to the fact that because the developer layers are densely packed along the lines of magnetic force, toner particles in the lower layers near the development sleeve cannot move up to the surface of the top layer.

SUMMARY OF THE INVENTION

The present invention has been accomplished to overcome the aforementioned technical problems and it is an object of this invention to provide a novel non-contact development method and apparatus as well as a multicolor image forming apparatus using these, which can ensure sufficiently high development performance during the multicolor image forming process without disturbing already formed toner images.

As shown in FIG. 1, this invention is characterized as follows. In a development apparatus which includes a developer supporting body 1 consisting of a rotatable non-magnetic sleeve 2 and a magnet roll 3 fixedly installed within the rotatable non-magnetic sleeve 2; a development method of this invention comprises the steps of: supporting a two-component developer G consisting of a toner T and a magnetic carrier C on the developer supporting body 1; developing or making visible a latent image Z formed on a latent image supporting body 4 with the two-component developer G carried on the developer supporting body 1 in a non-contact way; applying to the developer G in an effective development area m on the developer supporting body 1 a horizontal magnetic field $S_H$ which is orientated in the circumferential direction of the developer supporting body 1, the effective development area m facing the latent image supporting body 4; and applying a developer movement promotion magnetic field $S_F$ locally to a part K of the effective development area m on the developer supporting body 1 so that the developer G is expelled from that part K of the effective development area m and that chains of carrier C of the developer G in the developer expelled region K are slid at least in the circumferential direction of the developer supporting body.

In such a technical means, this invention concerns a non-contact development, a process in which a latent image Z formed on the latent image supporting body 4 is developed by the two-component developer G carried on the developer supporting body 1 in such a way that the developer layer does not come into contact with the latent image supporting body 4. This patent application, however, includes a development mode wherein a part of the developer G may come into slight contact with the surface of the latent image supporting body 1 during a dynamic behavioral state of the non-magnetic sleeve 2, as long as the gap between the surface of the latent image supporting body 4 and the surface of the developer supporting body 1 during the stationary condition of the non-magnetic sleeve 2 is larger than the thickness of the developer layer on the developer supporting body 1.

The magnetic poles (usually two magnetic poles of opposite polarities) for applying a horizontal magnetic field $S_H$ to the effective development area m that contributes to image development have the flux density in the range of 300 to 1500 gauss and the magnetic angle formed by the lines connecting each magnetic pole and the center of the magnet roll 3 in the range of 30 to 180 degrees. The flux density and the magnetic angle are determined by the radius of curvature (outer diameter) of the developer supporting body 1 if the developer supporting body 1 and the latent image supporting body 4 are formed cylindrical.

The developer movement promotion magnetic field $S_F$ need only expel the developer G locally from the developer supporting body 1 and causes the chains of developer carrier C to slide on the developer supporting body 1 in the developer expelled region K. Hence, the developer movement promotion magnetic field $S_F$ may be formed in various ways to meet this requirement. For example, it may consist of vertical and horizontal components that act in the radial and circumferential directions of the developer supporting body 1.

The carrier making up the developer preferably has as small a magnetic force per unit volume as possible from the standpoint of developer layer formation and image characteristics. Carrier particles should preferably be 20–50 μm in grain size. Controlling the carrier particle size distribution strictly by removing carrier particles smaller than 10 μm enables formation of a more uniform layer of developer.

To improve development performance, an AC bias $V_{CB}$ is preferably applied between the surface of the latent image supporting body 4 and the non-magnetic sleeve 2.

A development apparatus of this invention that implements the method mentioned above is constructed as shown in FIG. 1. That is, the development apparatus comprises: a developer supporting body 1 including a rotatable non-magnetic sleeve 2 and a magnet roll 3 fixedly installed within the rotatable non-magnetic sleeve 2, the developer supporting body 1 supporting thereon two-component developer G consisting of a toner T and a magnetic carrier C; a pair of horizontal field magnetic poles 5, 6 of opposite polarities installed in the magnet roll 3, the horizontal field=magnetic pole pair applying to the developer G in an effective development area m on the developer supporting body 1 a horizontal magnetic field $S_H$ that is oriented in the circumferential direction of the developer supporting body 1, the effective development area m facing a latent image supporting body; and at least one pair of developer movement promotion magnetic poles 7, 8 of opposite polarities installed in the magnet roll 3 at an intermediate position between the pair of the horizontal field magnetic poles 5, 6, the developer movement promotion magnetic pole pair applying to a part K of the effective development area m on the developer supporting body so that the developer is expelled from that part K of the effective development area m and that chains of carrier of the developer in the developer expelled region K are slid at least in the circumferential direction of the developer supporting body 1; whereby a latent image on the latent image supporting body 4 is developed or made visible in a non-contact manner by the two-component developer G carried on the developer supporting body 1.

In such a technical means, the horizontal field magnetic pole pair 5, 6 and the developer movement promotion magnetic pole pair (a magnetic pole pair for promoting the developer movement) 7, 8 may be formed in appropriate ways, as by using an ordinary magnetizing method or by embedding magnets in the developer supporting body.

The only criterion one should follow in determining design parameters for easy manufacture of the developer movement promotion magnetic pole pair 7, 8 of opposite polarities is that the developer movement promotion magnetic field $S_F$ produced by the magnetic pole pair 7, 8 be acted upon a polarity changing area or neutral area in a vertical component of the field produced by the horizontal field magnetic pole pair 5, 6 of opposite polarities so as to locally establish the developer expelled region K at or around the neutral area on the developer supporting body 1; and that the developer movement promotion magnetic field $S_F$ applied to the neutral area include a vertical component with a peak value smaller than that of the vertical component produced by the horizontal field magnetic pole pair 5, 6.

This method represents only one example method for making the developer movement promotion magnetic pole pair 7, 8 and is not intended at all to exclude other possible methods.

In setting the magnetic field strength and field pattern of the developer movement promotion magnetic pole pair 7, 8, it is essential to take into account the magnetic field strength and field pattern of the horizontal field magnetic pole pair 5, 3.

In this case, the developer movement promotion magnetic pole pair 7, 8 is formed to produce a flux density such that a vertical component of the magnetic flux produced by this magnetic pole pair expels the developer G—which was aligned along the horizontal magnetic field $S_H$—at least locally from between the magnetic poles 7, 8 but does not cause the developer to part from the developer supporting body 1 and such that a horizontal component of the magnetic flux causes the developer located in the developer expelled region K to slide in the circumferential direction of the developer supporting body 1.

The horizontal component of the developer movement promotion magnetic field $S_F$ must be an inverted horizontal component, which is opposite in direction to the horizontal magnetic field $S_H$ produced by the horizontal field magnetic pole pair 5, 6.

To make the sliding motion of the developer G more smooth, it is desired that the inverted horizontal component of the developer movement promotion magnetic field be applied only to the surface of the developer supporting body 1.

Under this condition, on the surface of the developer supporting body 1, the inverted horizontal component of the developer movement promotion magnetic field $S_F$ in the local area overcomes the horizontal magnetic field $S_H$. At locations radially displaced from the surface of the developer supporting body 1, on the other hand, the horizontal magnetic field $S_H$ overcomes the inverted horizontal component of the developer movement promotion magnetic field $S_F$.

The developer movement promotion magnetic field $S_F$ needs to act on only a part of the effective development area m on the developer supporting body 1. For the purpose of facilitating the adjustment of the height of the spike of the developer particles erected by the developer movement promotion magnetic field $S_F$ and also the gap between the tip of the rising developer spike and the latent image supporting body 4, it is preferred that the developer movement promotion magnetic pole pair 7, 8 be located in a position other than the point where the developer supporting body 1 is closest to the latent image supporting body 4, that is, the pole pair be situated in or around an upstream or downstream region of the effective development area m on the developer supporting body 1 to apply the developer movement promotion magnetic field $S_F$ to the upstream or downstream region of the effective development area m. (One of the paired magnetic poles 7 or 8 may be arranged outside the effective development area m.)

Although the developer movement promotion magnetic pole pair 7, 8 improves the development performance, it poses a problem that when the developer G uses a smaller diameter carrier (microcarrier) C, the microcarrier is apt to be developed around the written parts of the image or between lines in a high-frequency line image, a so-called micro carry-over phenomenon.

To effectively avoid the micro carry-over phenomenon, the magnetic pole 6 of the horizontal field magnetic pole pair located on the rotating direction side of the developer supporting body 1 should preferably be installed in or around the downstream region of the effective development area m. With this arrangement, the magnetized portion of the magnet roll 3 in the downstream region of the effective development area m will effectively attract and recover the carrier C that has transferred onto the latent image supporting body 4.

By making an appropriate adjustment on the magnetic force of the magnetic pole 6 in or around the downstream region of the effective development area m, it is possible to effectively avoid the micro carry-over phenomenon.

It is also noted that the developer movement promotion magnetic field $S_F$ does not have to be applied to only one location but may be made to act upon two or more locations, which is preferred from the standpoint of improving the development performance.

Representative applications of such a development apparatus include a multicolor image forming apparatus, in which a plurality of latent images Z are formed successively on the latent image supporting body 4 and developed successively with the corresponding color-toners T, and then the multiple color-toner images thus formed on the latent image supporting body 4 are transferred en masse onto a transfer medium. In the multicolor image forming apparatus, the above development apparatus may be effectively applied as a development processor to develop at least second or subsequent latent images.

The multicolor image forming apparatus may be of any type. For example, it may be of a type in which latent images of all colors are formed and developed during one complete rotation of the latent image supporting body 4 before being transferred onto the transfer medium at one time, or another type in which the latent image supporting body is rotated several times to form and develop a latent image of each color in each rotation before transferring the developed multicolor image onto the transfer medium at one time.

While the development apparatus of this invention is effectively applied for developing second or subsequent latent images in the multicolor image forming apparatus, it may also be used for developing the first latent image by changing development parameters such as a development bias voltage.

Next, the functions and advantages of this invention will be described.

In the above-mentioned technical means, when the effective development area m between the surfaces of the developer supporting body 1 and the latent image supporting body 4 is applied with the horizontal magnetic field $S_H$ produced by two magnetic poles 5, 6 of opposite polarities, the developer G spread over the non-magnetic sleeve 2 is aligned along the lines of magnetic force, forming highly dense, uniform thin layers of developer over the non-magnetic sleeve 2.

Further, a pair of two magnetic poles 7, 8 of opposite polarities, arranged close together, whose magnetic force is different in magnitude from the horizontal magnetic field $S_H$ produced by the magnetic poles 5, 6, are located in a part of the effective development area m to apply vertical and horizontal components of the developer movement promotion magnetic field $S_F$ locally to that part of the effective development area m. (The horizontal component of the developer movement promotion magnetic field $S_F$ is an inverted horizontal component, which is opposite in direction to the horizontal magnetic field $S_H$) The vertical component of the developer movement promotion magnetic field $S_F$ expels the developer G locally from that part of the effective development area m, causing chains of developer carrier C to rise. And the inverted horizontal component of the developer movement promotion magnetic field $S_F$ causes the chains of developer carrier C to slide in the developer expelled region K on the surface of the non-magnetic sleeve 2 and fall onto the developer cluster located circumferentially downstream on the developer supporting body 1.

Depending on the extent to which the thickness of the developer layer is restricted and on the direction and magnitude of the horizontal magnetic field $S_H$ acting at a location radially away from the developer supporting body 1, the tips of the carrier chains may fly along the magnetic field in the circumferential direction of the developer supporting body 1.

Various motions of developer, such as forming of developer into rising chains of carrier C and sliding and toppling of the erect carrier chains, cause the developer to move from one layer to another. In addition, flying carrier particles C strike the developer cluster located downstream, agitating and driving the toner particles out of the cluster.

As the developer movement is excited in an restricted region within the effective development area m by the developer movement promotion magnetic field $S_F$, i.e. the motion of the carrier particles of the developer becomes active, transfer of toner particles T from the surface of carrier particles C to the latent image supporting body 4 under the electric field is promoted, achieving higher development performance under the same development conditions (including development electric field intensity, development sleeve rotation and toner density in the developer).

As described above, in the non-contact development method of this invention using two-component developer, the amount of toner contributing to the development is increased by applying a horizontal magnetic field to the effective development area to produce thin, uniform layers of developer and also applying a developer movement promotion magnetic field to only a part of the effective development area to cause the carrier chains to slide and fall over the surface of the developer supporting body. Hence, during the multicolor image forming process, the already formed toner images can be protected against mechanical contact and friction by the magnetic brush in the subsequent development stages, making it possible to eliminate image flaws such as mixing of colors and disturbed images. It is also possible to obtain a sufficiently high development density, thus producing images of good quality.

The developer movement promotion magnetic field can be formed easily by using a pair of two magnets of opposite polarities, arranged close together, to produce vertical and horizontal components of the field in the radial and circumferential directions, respectively, of the developer supporting body.

An AC bias may also be used to further increase the amount of toner contributing to the development and therefore the development density.

Further, by clearly defining the layout of the developer movement promotion magnetic pole pair and the criterion for easily determining the developer movement promotion magnetic field, it is possible to manufacture the developer movement promotion magnetic pole pair with ease.

By optimizing the intensity of the vertical component of the field, which is produced by the developer movement promotion magnetic pole pair and acts in the radial direction of the developer supporting body, it is possible to expel developer locally from the developer supporting body and cause the developer to rise upright without leaving the developer supporting body. This minimizes the developer carry-over phenomenon while at the same time securing a space for exciting the developer movement.

The horizontal component of the field produced by the developer movement promotion magnetic pole pair (called an inverted horizontal component) is orientated in a direction opposite to the horizontal magnetic field produced by the horizontal field magnetic pole pair which acts in the circumferential direction of the developer supporting body. Applying the inverted horizontal component only to the surface of the developer supporting body ensures that the chains of developer carrier are reliably made to slide and topple in the developer expelled region on the developer supporting body, thereby exciting the movement of the developer with ease.

If the developer movement promotion magnetic field is applied to the upstream or downstream region of the effective development area, i.e. the region on the developer supporting body acted upon by the developer movement promotion magnetic field is deviated from the point where the developer supporting body is closest to the latent image supporting body, variations in the height of upright carrier chains—which are made to rise in the radial direction by the vertical component of the developer movement promotion magnetic field—can be effectively absorbed even when the developer layer thickness is somewhat loosely controlled.

When the developer uses smaller-diameter carrier particles, there is a possibility of the carrier particles flying onto the latent image supporting body. In that case, one of the paired horizontal field magnetic poles on the magnet roll on the rotating direction side of the non-magnetic sleeve is situated in the downstream region of the effective development area. With this arrangement, it is possible to attract and collect the transferred carrier particles back from the latent image supporting body by the magnet installed in the downstream region of the effective development area. This effectively eliminates deterioration of image quality due to micro carry-over phenomenon.

Furthermore, the magnetic pole located in the downstream region of the effective development area also seals the toner cloud that occurs in the effective development area, thus effectively preventing contamination of the interior of the equipment.

The development performance can be further improved by applying the developer movement promotion magnetic field to a plurality of locations in the effective development area.

DETAILED DESCRIPTION OF THE INVENTION

The present invention will now be described in detail in conjunction with example embodiments by referring to the accompanying drawings.

[Embodiment 1]

Figure 1:
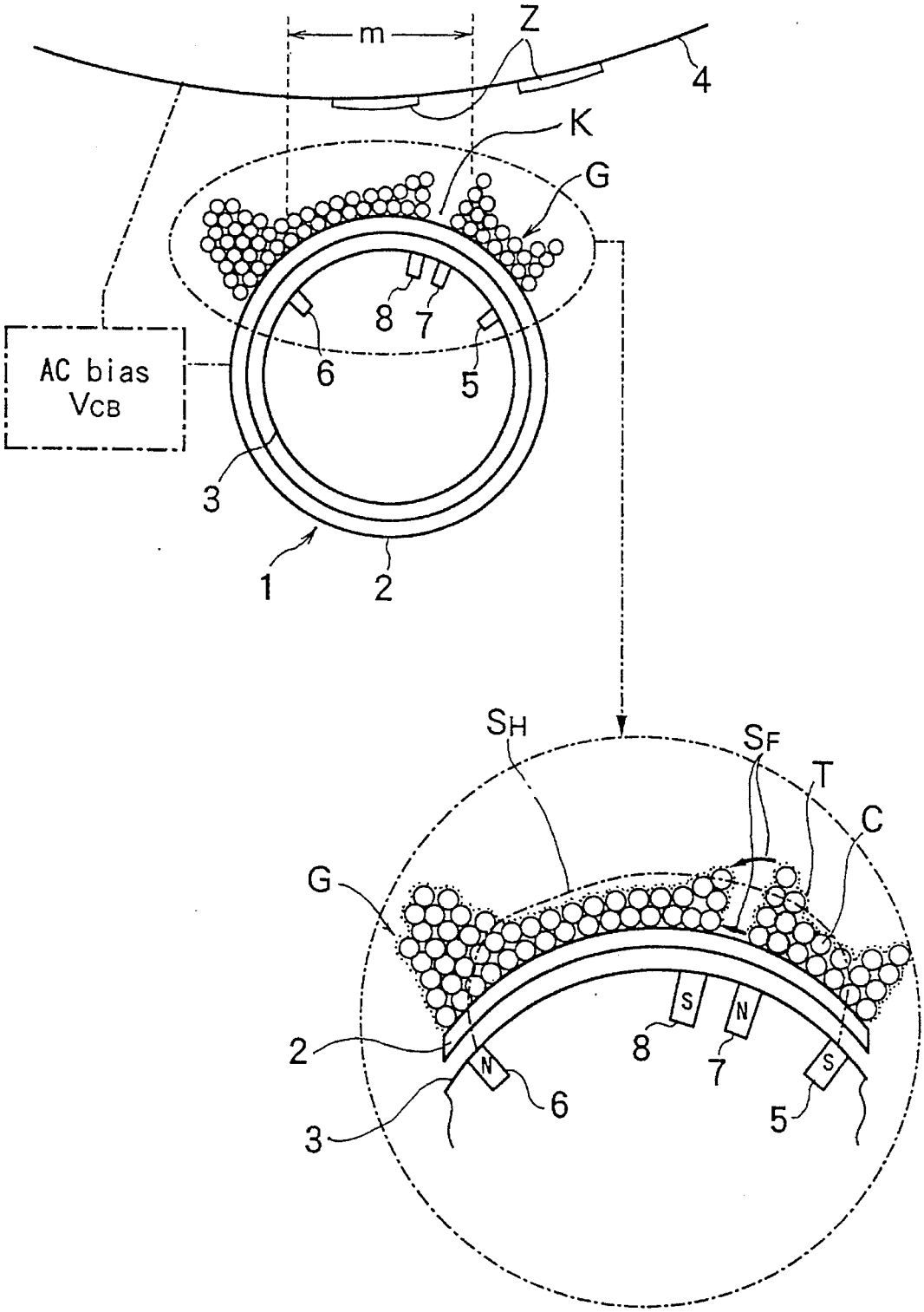
FIG. 1 is a schematic diagram showing the outline of the development method and apparatus according to this invention.
Figure 2:
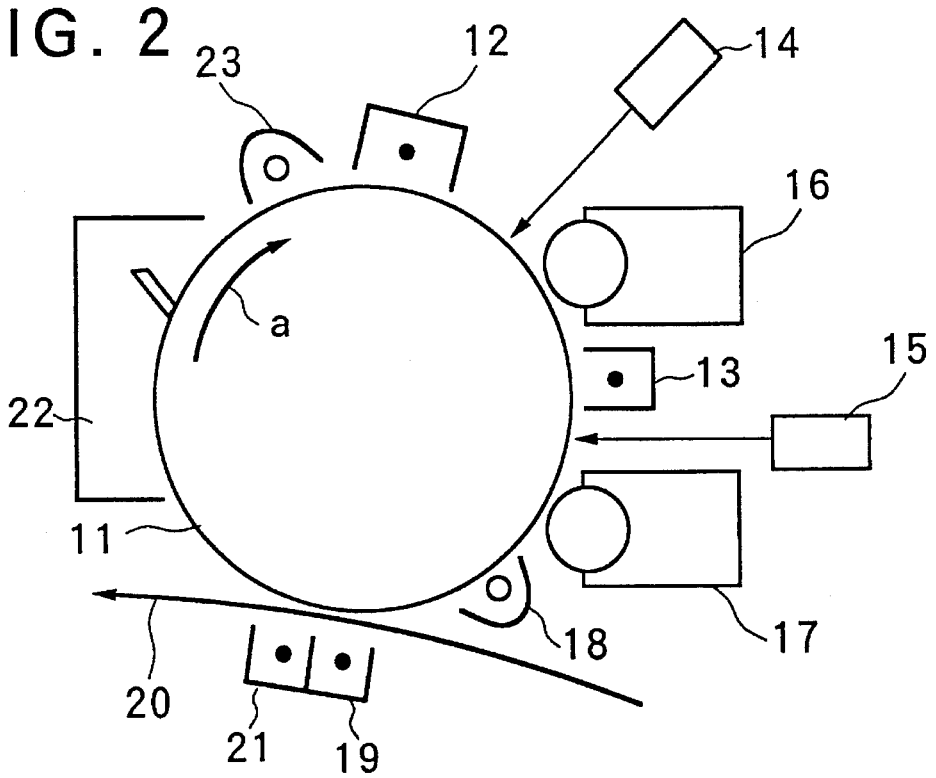
FIG. 2 is an overall schematic view of a multicolor image forming apparatus as Embodiment 1 using the development apparatus of this invention.

FIG. 2 shows one embodiment of a multicolor image forming apparatus using the development method according to this invention.

In the figure, denoted 11 is a negatively charged photosensitive body that rotates in the direction a; 12 and 13 represent first and second chargers (in the embodiment, scorotron) that charge the photosensitive body 11; 14 and 15 indicate first and second raster output scanners constructed of, for example, semiconductor lasers (optical writing device with a resolution of 400 spots per inch); 16 and 17 signify first and second development processors charged to the same polarity but with different colors; and reference numeral 18 represents a transfer preprocessing lamp that illuminates a two-color toner image formed on the photosensitive body 11 to adjust the potential of the image. A transfer charger 19 transfers the entire two-color toner image from the photosensitive body 11 onto recording paper 20. A peel charger 21 peels the recording paper 20 from the photosensitive body 11 after the toner image has been transferred. A cleaner 22 removes residual toner adhering to the photosensitive body 11. A charge eliminating lamp 23 removes residual charge on the photosensitive body 11.

In this,embodiment, the first processor 16 employs a contact magnetic brush developing method while the second processor 17 applies a non-contact magnetic brush developing method of this invention.

Figure 3:
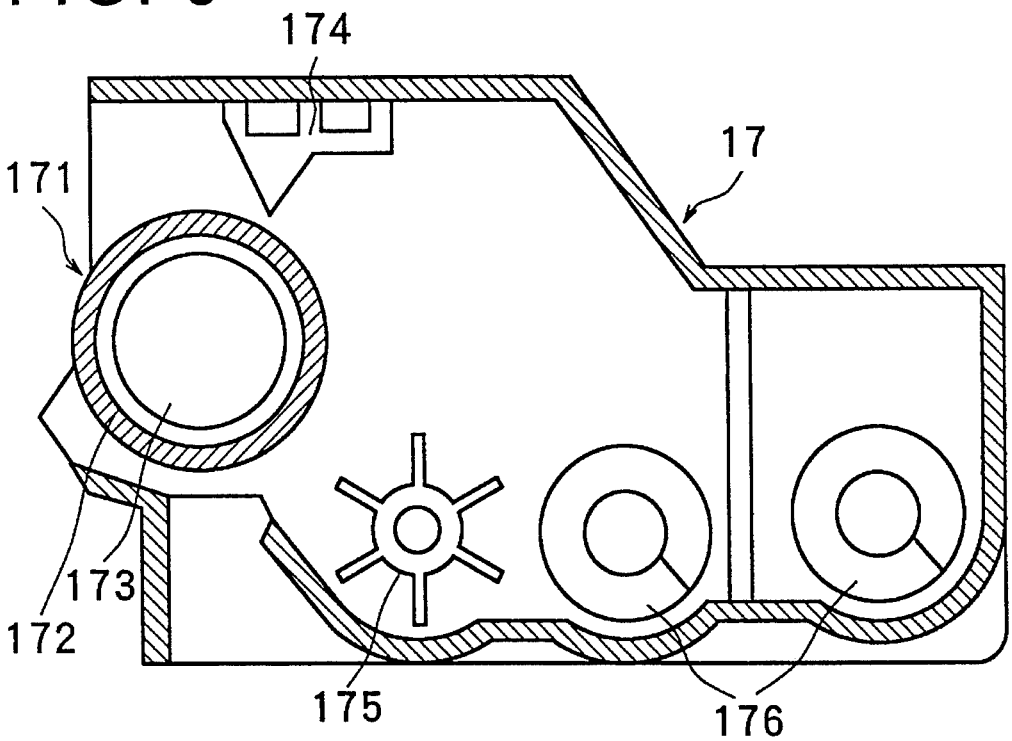
FIG. 3 is a schematic cross section showing the construction of a second development processor in the Embodiment 1.

Details of the second processor 17 are shown in FIG. 3.

The second processor 17 includes as main components: a development roll 171 consisting of a rotatable non-magnetic sleeve 172 with average surface roughness of 10–50 μm and a magnet roll 173 installed inside the sleeve 172; a developer restraining member 174 made of a non-magnetic material and held a small distance from the non-magnetic sleeve 172; and a paddle 175 and augers 176.

Figure 4:
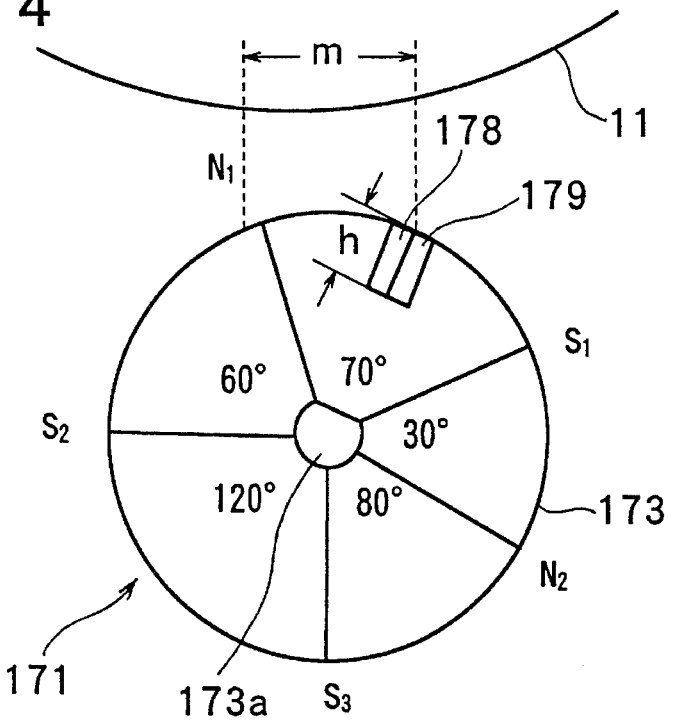
FIG. 4 is a schematic view showing the construction of the magnet roll in the second development processor.

As shown in FIG. 4, the magnet roll 173 has a predevelopment magnetic pole S1 and a postdevelopment magnetic pole N1 to produce a developer-packing horizontal magnetic field that acts on an effective developing area m, where the actual development process takes place. Between the predevelopment and post development magnetic poles S1 and N1, the magnetic roll 173 also has in an upstream part of the effective development area m (i.e. a region on the inlet side) first and second development promotion magnetic poles (first and second magnetic poles for promoting the developer movement) S1' and N1' of opposite polarities to produce a magnetic field that acts to promote movement of the developer. The magnetic roll 173 is further provided with a pickoff magnetic pole S2 to remove developer from the sleeve 172 after it has moved past the effective development area, a pickup magnetic pole S3 to cause the developer to adhere to the sleeve 172 and a trimming magnetic pole N2 to form a thin layer of developer.

In this embodiment, the magnetic poles S1–S3 and N1–N2 except for the development promotion magnetic poles S1', N1' are formed by magnetizing appropriate portions of the magnet roll 173. The development promotion magnetic poles S1', N1' are formed by embedding magnets 178, 179 into grooves cut at the predetermined positions in the magnet roll 173.

Figure 5:
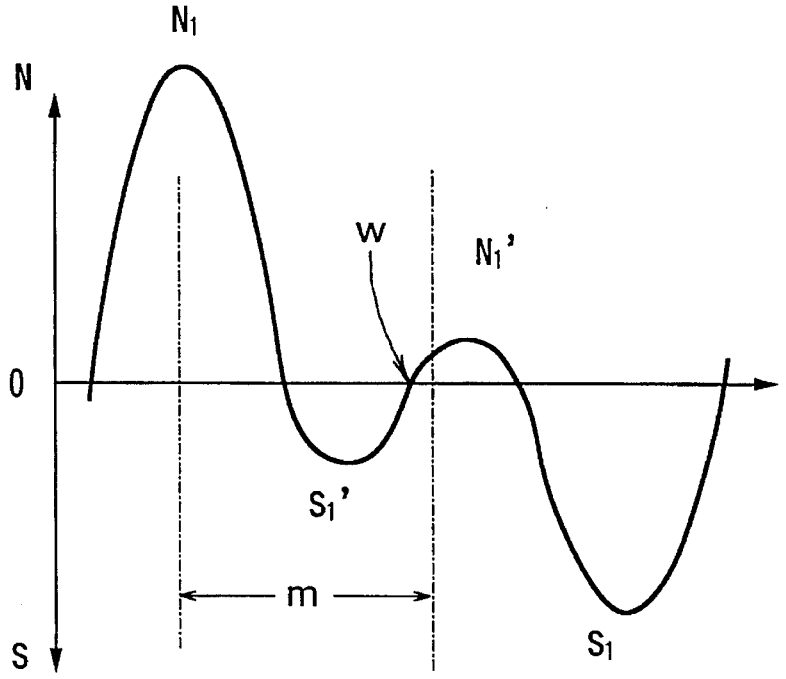
FIG. 5 is a graph showing the radial component distribution of the magnetic force produced by the magnet roll.

FIG. 5 shows the magnetic force distribution in the radial direction of the magnet roll 173 in this embodiment.

It is seen from FIG. 5 that the central part w between the development promotion magnetic poles S1', N1' of opposite polarities is positioned at the upstream portion of that effective development area m of the development roll 171 which faces the photosensitive body 11. In the downstream portion of the effective development area m the magnetic force of the postdevelopment magnetic pole N1 is shown to be dominant.

In this embodiment, in particular, the development promotion magnetic poles S1', N1' influence a polarity changing area or neutral area in a radial component (vertical component) of the magnetic force produced by the development magnetic poles S1 and N1 of opposite polarities to locally establish a developer expelled region K (described later) at or around the neutral area on the development roll 171. The magnetic force produced by the development promotion magnetic poles S1', N1' and applied to the neutral area has a radial component with a peak value less than that of the radial component (vertical component) of the magnetic force generated by the development magnetic poles S1, N1.

In this magnetic force distribution, the development magnetic poles N1, S1 produce the magnetic force of 300–1200 gauss. The magnets 178, 179 measure 4 mm high by 3 mm wide and the development promotion magnetic poles S1', N1' formed of these magnets 178, 179 produce the magnetic force of 50–400 gauss.

Figure 6:
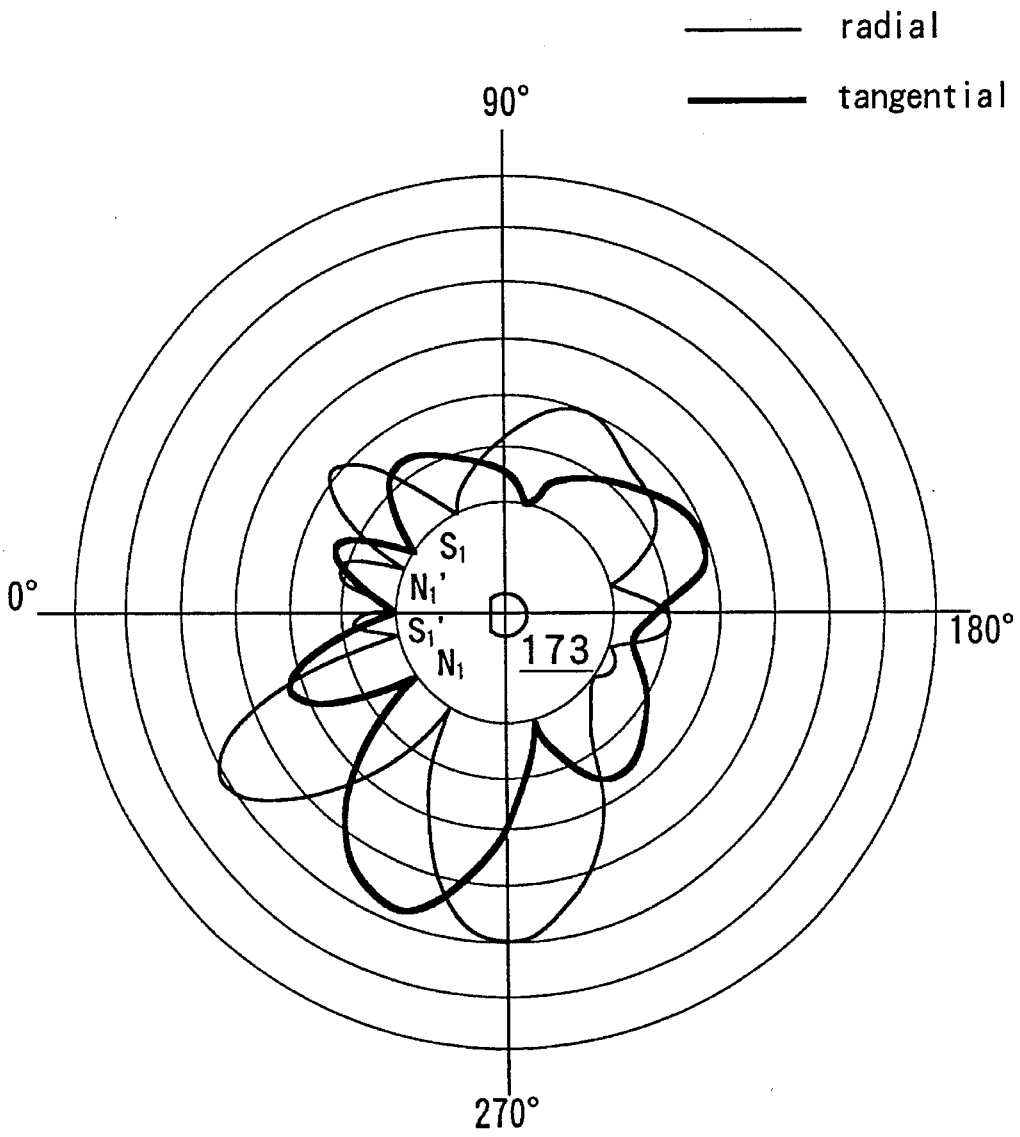
FIG. 6 is a diagram showing an example of the magnetic force distribution produced by the magnet roll.

The magnetic force distribution is explained in more detail by referring to FIG. 6. A line denoted "radial" represents a magnetic force component in the radial direction and a line designated "tangential" represents a magnetic force component in the circumferential direction. As shown in FIG. 4, the direction perpendicular to a cut surface of the support shaft **173*a* of the magnet roll 173 is taken as the reference position (0°). The radial component of the magnetic force produced by the predevelopment magnetic pole S1 (offset 40° from the reference position) is set to 420 gauss; the radial component of the magnetic force produced by the development promotion magnetic pole N1' (offset15° from the reference position) is set to 240 gauss; the radial component of the magnetic force produced by the development promotion magnetic pole S1' (offset 355° from the reference position) is set to 170 gauss; and the radial component of the magnetic force produced by the post development magnetic pole N1** (offset 330° from the reference position) is set to 820 gauss.

Figure 7:
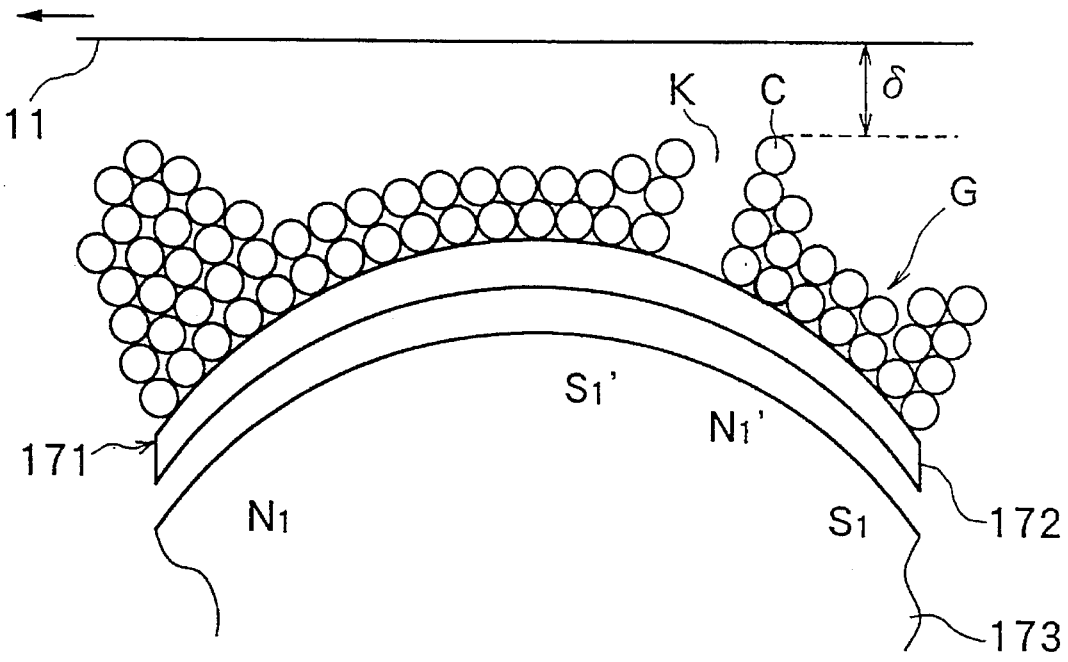
FIG. 7 is an explanatory view showing the behavior of the developer with the development roll stationary.

What should be born in mind in setting the magnetic forces of the development promotion magnetic poles S1', N1' is that a specified gap δ shown in FIG. 7 must be formed between the photosensitive body 11 and the crest or spike of the developer cluster G that rises along the vertical magnetic field of the development promotion magnetic poles S1', N1' when the development roll 171 is stationary.

In this embodiment in particular, the position of the spike of the developer cluster G that rises along the vertical magnetic field produced by the development promotion magnetic poles S1', N1' is shifted upstream of the point where the development roll 171 is closest to the photosensitive body 11. This arrangement enables the gap δ to be set easily even when the developer restraining member 174 has a somewhat coarse precision in adjusting developer cluster layer thickness and when there are variations in the height of the developer cluster spikes.

Figure 8:
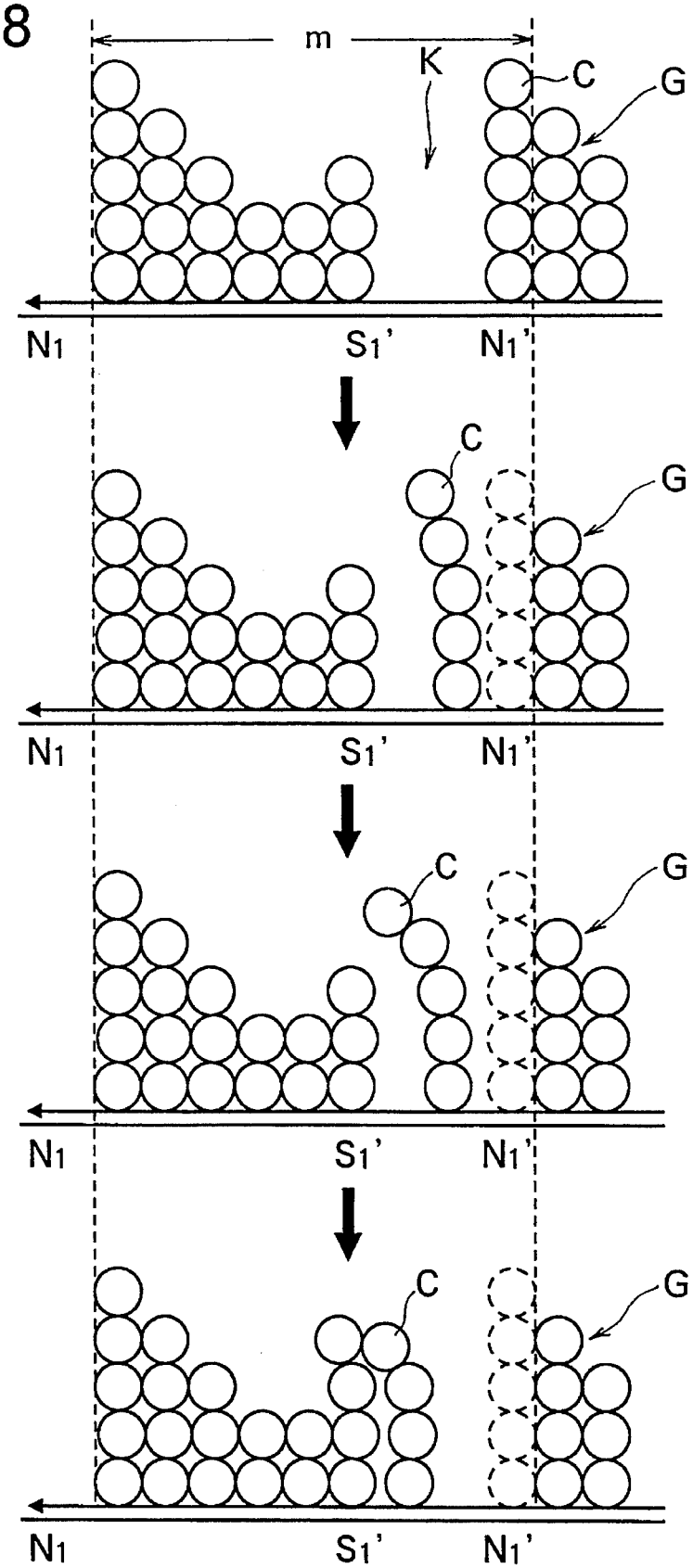
FIG. 8 is explanatory views showing the behaviors of the developer in the effective development area with the development roll in motion.

With the magnetic forces of the development promotion magnetic poles S1', N1' set in this way, there is a small region K formed between these magnetic poles S1', N1' from which the developer G is expelled when the development roll 171 is stationary. In the dynamic state of the development roll 171, a unique behavior of the developer G has been observed. That is, as the development roll 171 rotates, a chain of developer carrier C located in the developer expelling region K between the development promotion magnetic poles S1', N1' in the effective development area m slides on the development roll 171 in the rotating direction (or circumferential direction) of the roll 171 and falls, as shown in FIG. 8.

During this process, it was observed that a part of the carrier at the tip of the carrier chain flies circumferentially toward and strikes against the developer G located downstream.

Figure 9:
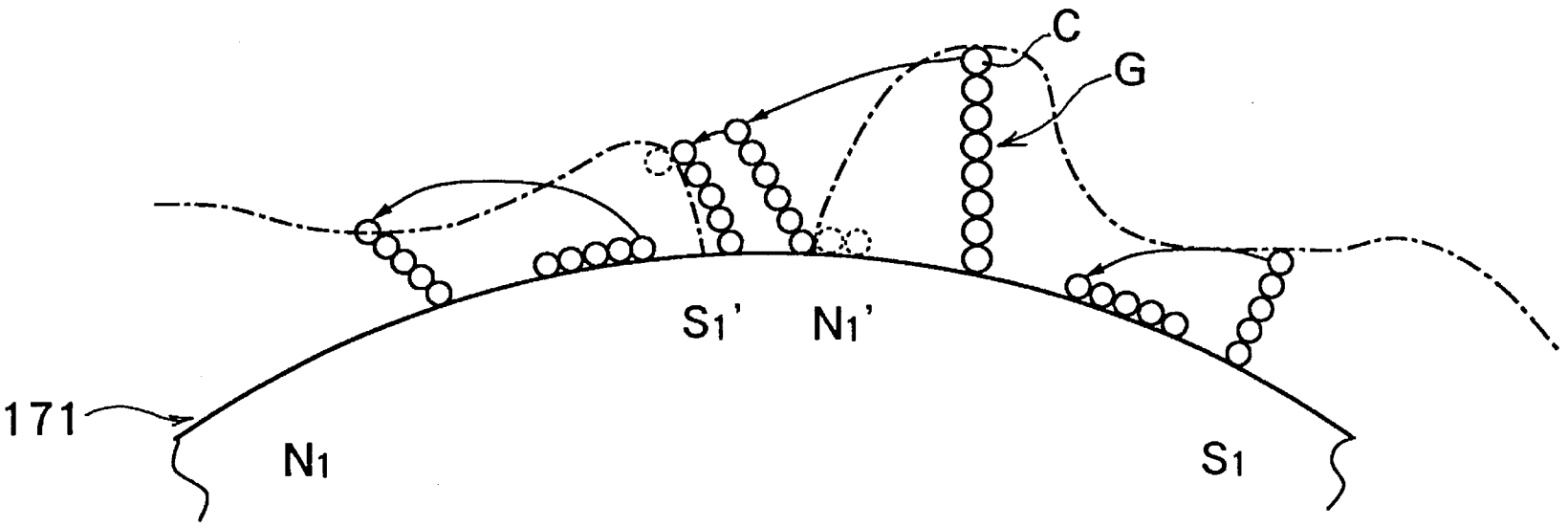
FIG. 9 is an explanatory view showing the behavior of the developer in a region upstream of the effective development area.

Another peculiar behavior was observed in a region upstream of the development promotion magnetic poles S1', N1', i.e. in a region upstream of the effective development area m. That is, between the predevelopment magnetic pole S1 and the development promotion magnetic poles S1', N1', chains of developer carrier C rotate, as shown in FIG. 9, while moving toward the development promotion magnetic poles S1', N1', which is considered to produce disturbance within the developer G. In FIG. 9, a one-dot line denotes a surface of the developer layer.

Such behaviors of the chains of developer carrier C were observed by a microscope as the development roll 171 with the built-in magnet roll 173 that has the above-mentioned mentioned magnetic force distribution was slowly turned.

Figure 10:
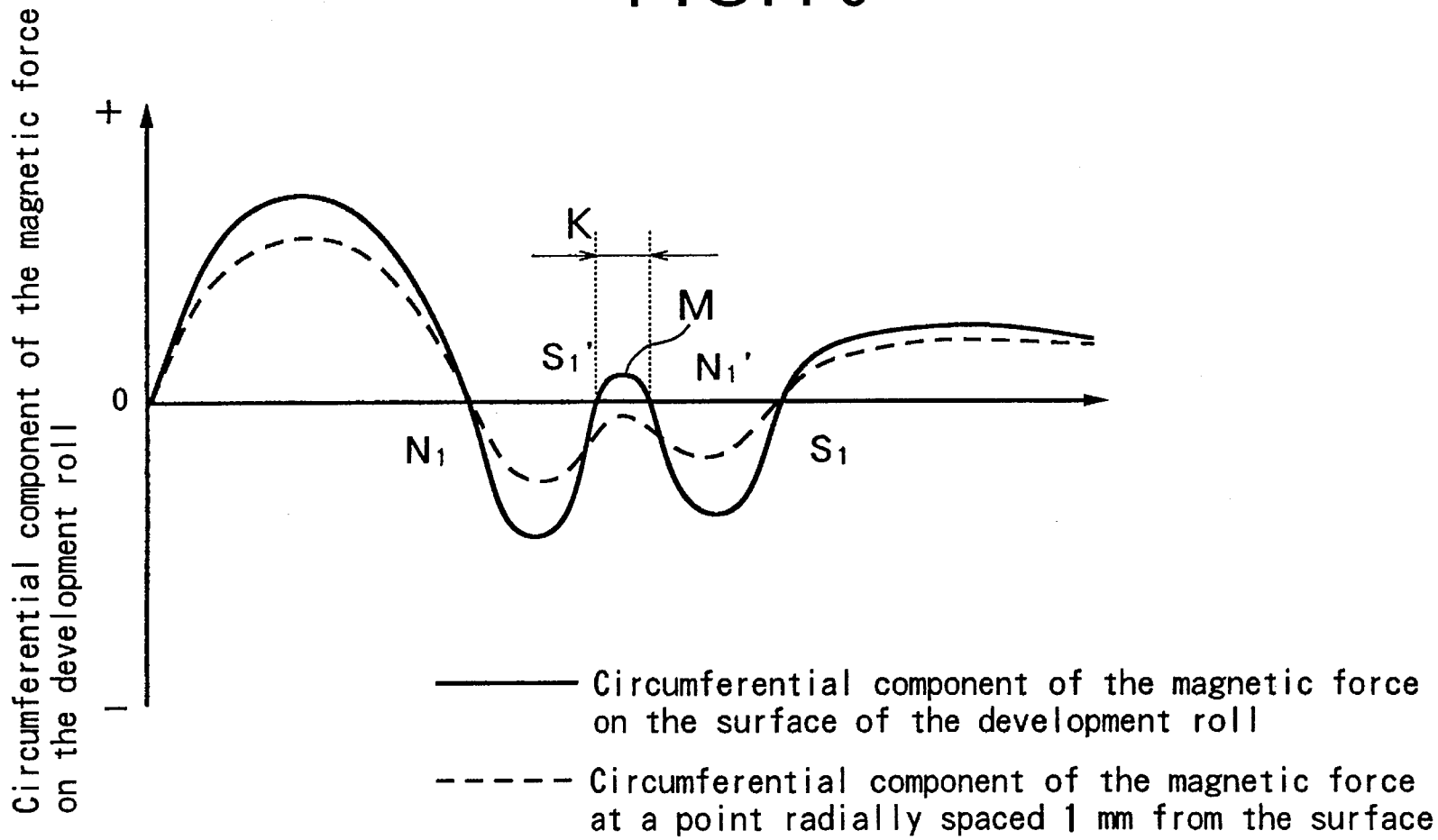
FIG. 10 is a graph showing the circumferential component distribution of the magnetic force at positions 1 mm away from the surface of the development roll.

Further examination has found that the circumferential component of the magnetic force on the surface of the development roll 171 changes as indicated by a solid line in FIG. 10. At a point radially spaced 1 mm from the surface of the development roll 171, it is also found that the circumferential component of the magnetic force varies as illustrated by a broken line in FIG. 10. In FIG. 10, the "+" sign on the ordinate represents the direction of rotation of the sleeve and the "–" sign represents the opposite direction.

Figure 11:
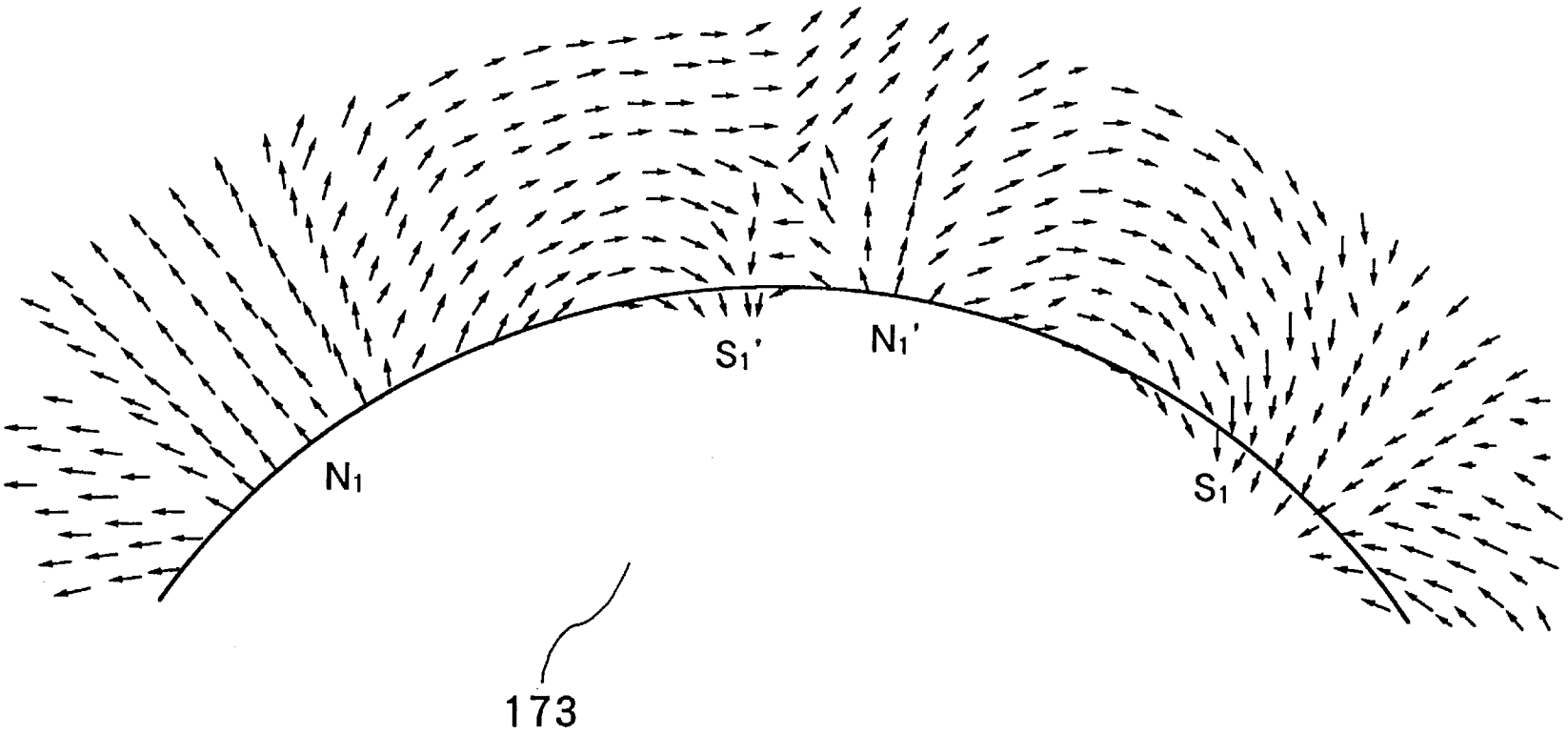
FIG. 11 is an explanatory view showing the directions of magnetic lines of force surrounding the magnet roll.

Plotting the directions of magnetic lines of force around the development roll 171 produced the result shown in FIG. 11.

FIG. 10 and FIG.11 show that the magnetic force on the surface of the development roll 171 in the developer expelled region K between the development promotion magnetic poles S1', N1' has an inverted horizontal magnetic field component M, a horizontal component whose direction is opposite to the horizontal field in other regions than the developer expelled region K whereas the horizontal magnetic field at a point 1 mm radially away from the surface of the development roll 171 is orientated in the same direction. The inverted horizontal magnetic field component M is therefore considered to contribute to the peculiar behaviors of the chains of developer carrier C such as sliding and falling.

The magnetic forces of the development promotion magnetic poles S1', N1' of opposite polarities can be controlled either by changing the depth h of the groove in the magnet roll 173 (FIG. 4) or by changing the magnetic forces of the magnets 178, 179. Further, it is also possible to control the magnetic forces of the predevelopment and postdevelopment magnetic poles S1, N1, the angle between S1 and N1 and the angle between development promotion magnetic poles S1' and N1'.

The developer restraining member 174 is disposed facing the magnetic pole N2 with a small gap therebetween. The paddle 175 forces developer removed from the sleeve 172 by the pickoff magnetic pole S2 toward the auger 176, which has the function of stirring up the removed developer and mixing the developer in the development processor with the toner supplied from the toner hopper (not shown).

Next, the image making process carried out by the multicolor image forming apparatus according to this invention will be described with reference to FIG. 12.

The charging process a charges the surface of the photosensitive body uniformly (at a first initial charging potential VDDP1); the first exposing process b forms a first latent image corresponding to information on the original being copied (at a potential VL1 for written portions of the original and at a potential VH1 for non-written portions); and the first development process c performs an inverted development on written portions of the first latent image (at a development bias potential VB1). Then, the recharging process d uniformly recharges the surface of the photosensitive body (at a second initial charging potential VDDP2); the second exposing process e forms a second latent image corresponding to other information on the original being copied (at a potential VL2 for written portions of the original and at a potential VH2 for non-written portions); and the second development process f performs an inverted development on written portions of the second latent image(at a development bias potential VB2). Having undergone these processes, the photosensitive body forms a two-color toner image on its surface.

In accordance with the above procedure, an image was formed under the following experimental conditions.

- Photosensitive body Organic photosensitive body (negatively charged) Drum outer diameter: 84 mm
- Processing speed: 160 mm/sec
- First developer (toner concentration 3.0%)
  - Two-component developer (negatively charged red toner)
  - Carrier Ferrite carrier with average grain diameter of 100 μm
  - Red toner 90 parts by weight of styrene-n-butylmethacrylate copolymer, 8 parts of red pigment (Lithol Scarlet of BASF make), and 2 parts of charge control agent (E-84 of Orient Chemical make) are mixed, melted, kneaded and then pulverized into minute particles with average grain diameter of 12 μm; the toner is then charged negatively with respect to the carrier.
- Second developer (toner concentration 8.0%)
  - Two-component developer (negatively charged black toner)
  - Carrier 35 parts by weight of polymethylmethacrylate copolymer and 65 parts of magnetite are mixed, melted, kneaded and pulverized into minute grains of magnetic powder dispersion type with average diameter of 45 μm and density of 2.2 g/cm$^3$.

Black toner 93 parts by weight of styrene-n-butyl-methacrylate copolymer and 7 parts of carbon black are mixed, melted, kneaded and then pulverized into minute particles with average grain diameter of 11 μm; the toner is then charged negatively with respect to the carrier.

Parameters of the first development processor (development of contact type)

DRS (gap between the photosensitive body and the feeding member: 0.6 mm

MSA (main development pole setting angle): +5°

TG (gap between the layer thickness restraining member and the sleeve): 0.50 mm

Outer diameter of the development sleeve: 20 mm

Rotating speed of the development sleeve: 480 mm/sec

Rotating direction of the development sleeve: same direction as the photosensitive body Parameters of the second development processor (development of non-contact type)

DRS: 0.5 mm

MSA: between poles

TG: 0.65 mm

Outer diameter of the development sleeve: 24.5 mm

Figure 12:
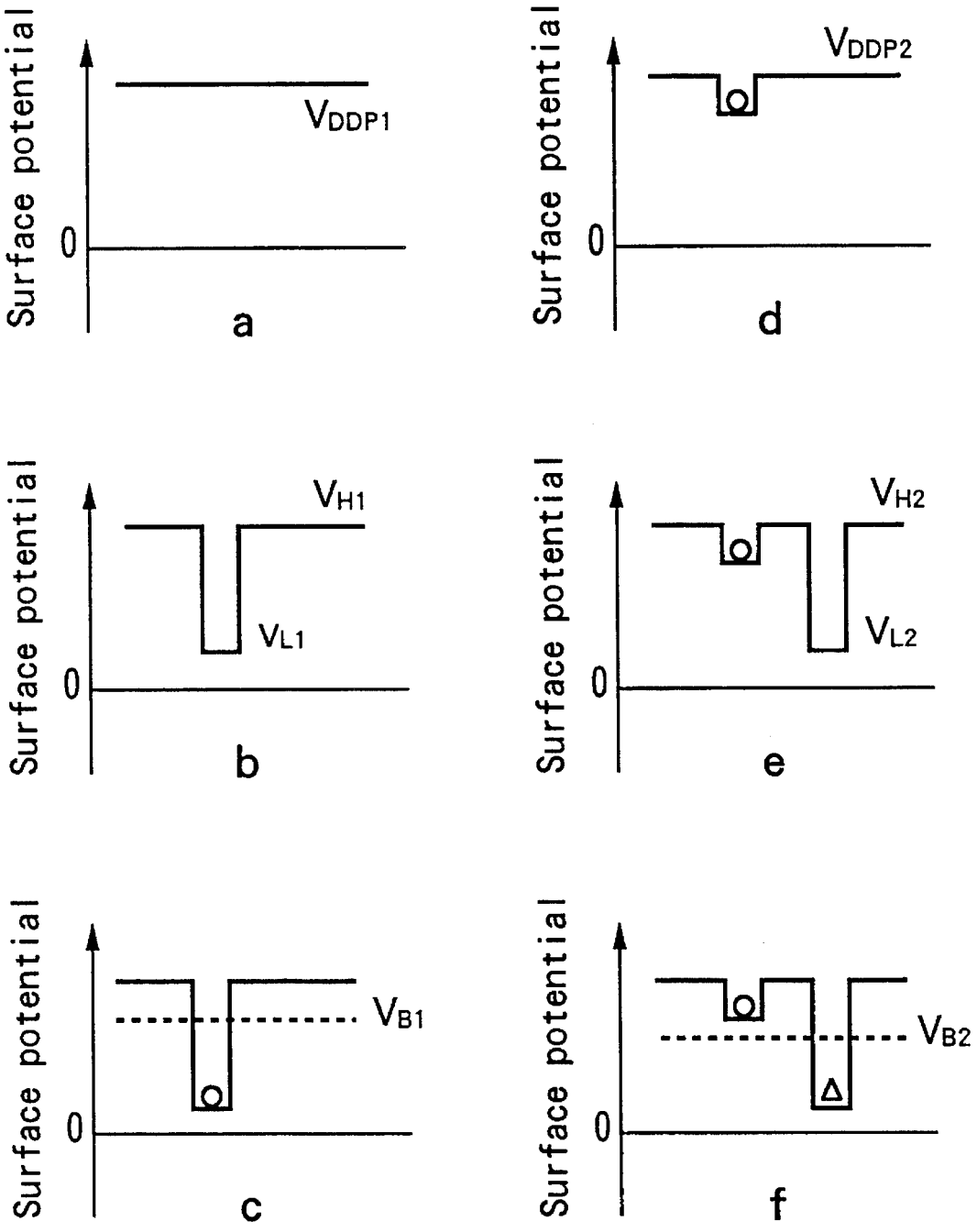
FIG. 12 is explanatory diagrams showing the image forming process carried out in the multicolor image forming apparatus of Embodiment 1.

Rotating direction of the development sleeve: same direction as the photosensitive body Voltage applied to the transfer charger: 400 Hz, 8.5 kVp-p, +2.5 kVdc The potentials used in the latent image forming process shown in FIG. 12 include, for the first image, −600 V as the first initial charging potential VDDP1, −600 V as the first non-written portion potential VH1, −100 V as the first written portion potential VL1, and −500 Vdc as the first development bias voltage VB1. For the second image, the second non-written portion potential VH2 was set at −600 V, the second written portion potential VL2 at −100 V, and the second development bias potential VB2 at −500 Vdc.

The images were formed under the above conditions and it was found that there was no second development toner mixed into the first image and that the second image produced the reflection density of more than 1.2.

Almost no carrier was found to have adhered between lines in a high-frequency line image (in this embodiment 2 line-pairs/mm)

[Image for Comparison]

With no development promotion magnetic poles S1', N1' attached to the magnet roll 173 of the second development processor 17, an image was formed under the same conditions as the first embodiment. While no second development toner was found mixed into the first image, the second image was able to produce the reflection density only up to 1.0.

[Embodiment 2]

The second development processor 17 was set with the bias condition of 2.5 kHz, 1.0 kVp-p and −500 Vdc. With other conditions the same as the first embodiment, the similar experiment was conducted and it was found that there was no second development toner mixed into the first image and that the second image produced the reflection density of more than 1.4. As in the first embodiment, almost no carrier was found attached between lines in the high-frequency line image (in this embodiment 2 line-pairs/mm).

[Embodiment 3]

This embodiment has similar conditions to those of the second embodiment, except that the amount of developer supplied into the processor is set greater than the second embodiment.

Examination of the behavior of the developer on the development roll 171 has shown that as the sleeve 172 rotates, the developer slides and fall in the developer expelling region K near the sleeve 172 whereas at a point radially displaced from the sleeve 172 in the developer expelling region K more carrier than in the first embodiment flies downstream in the circumferential direction of the development roll 171.

In this embodiment also, there was no second development toner mixed into the first image, and the second image had the reflection density of more than 1.4, as in the second embodiment. However, when the developer supply was set too high, a relatively large amount of carrier was found attaching between the lines in the high-frequency line image. This is considered due to the fact that the excited phenomenon of flying carrier produces greater opportunities for the upper layer of the developer to come into contact with the surface of the photosensitive body 11.

[Embodiment 4]

Figure 13:
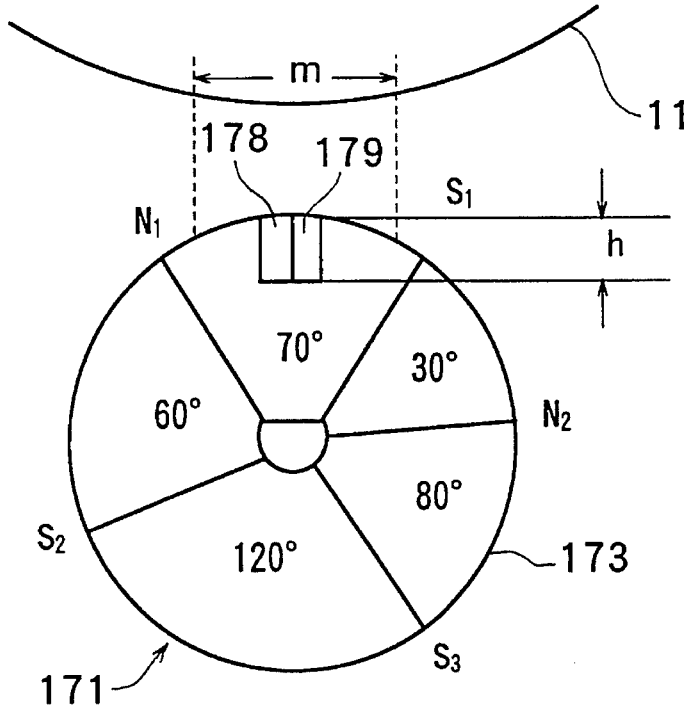
FIG. 13 is a schematic diagram showing the construction of the magnet roll used in the second development processor of Embodiment 4.
Figure 14:
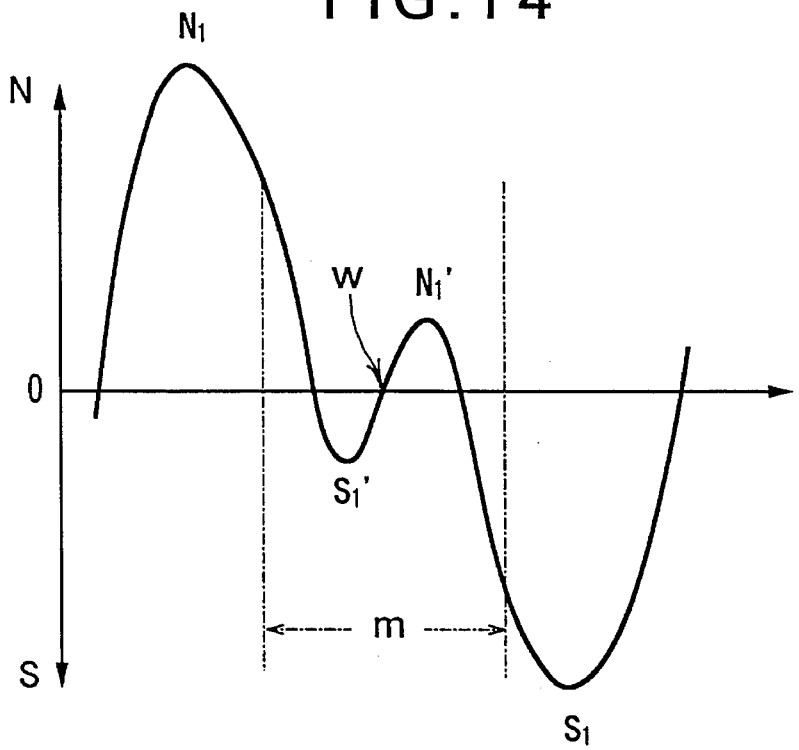
FIG. 14 is a graph showing the magnetic force distribution produced by the magnet roll of FIG. 13.

In this embodiment, a magnet roll 173 incorporated in the second development processor 17, as shown in FIGS. 13 and 14, has development promotion magnets S1', N1' installed in a roughly central part between the predevelopment and postdevelopment magnetic poles S1 and N1 (in this embodiment, at the center in the effective development area m corresponding to the point closest to the photosensitive body 11). Using this magnet roll 173 an image was formed under the same conditions as the second embodiment. The second development toner did not mix into the first image, and the second image produced the reflection density of more than 1.4.

Relatively large amounts of carrier were observed adhering between the lines in the high-frequency line image (in this embodiment 2 line-pairs/mm).

[Embodiment 5]

Figure 15:
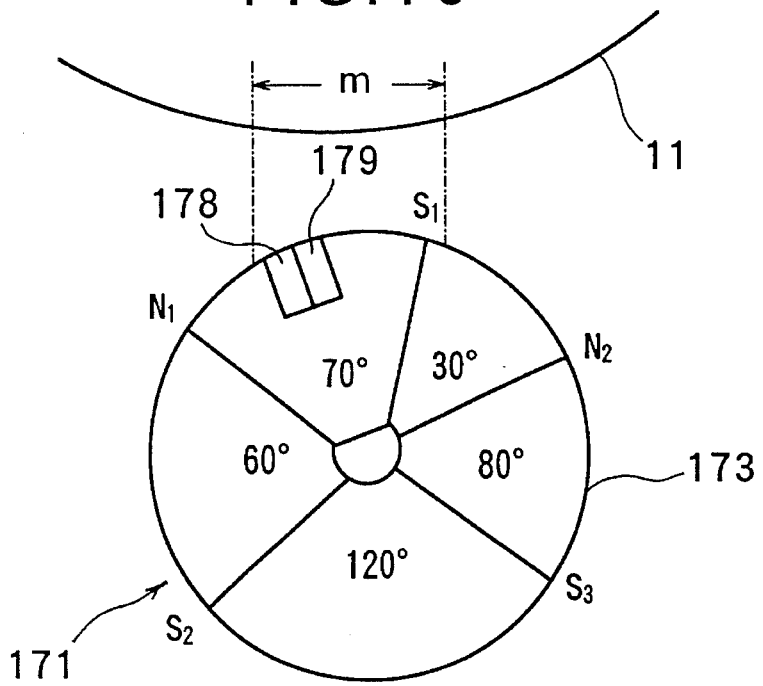
FIG. 15 is a schematic diagram showing the construction of the magnet roll used in the second development processor of Embodiment 5.
Figure 16:
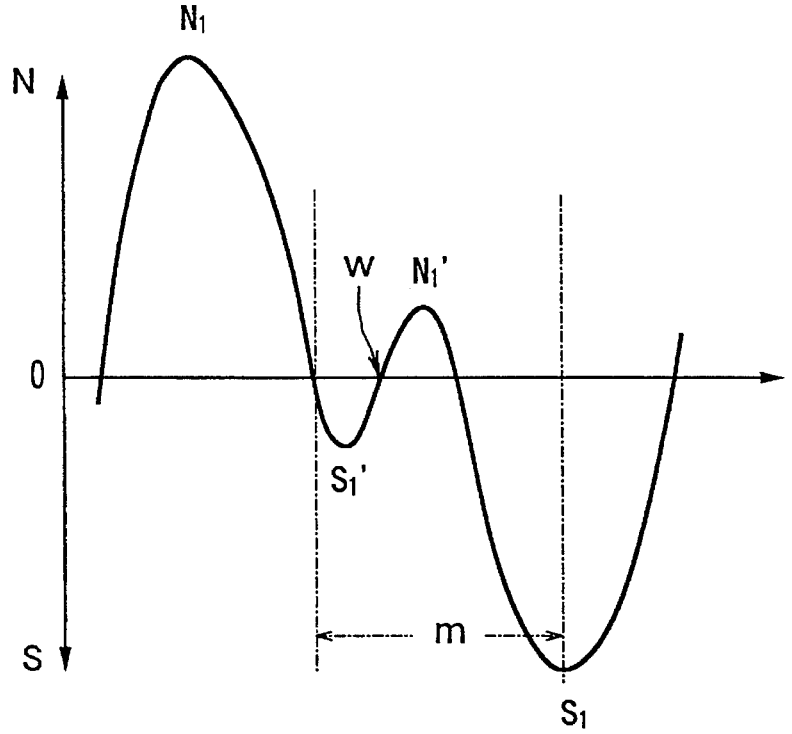
FIG. 16 is a graph showing the magnetic force distribution produced by the magnet roll of FIG. 15.

In the second development processor 17 in this embodiment, a magnet roll 173 has the development promotion magnetic poles S1', N1' installed in the downstream portion of the effective development area m, as shown in FIGS. 15 and 16. Using this magnet roll 173, an image was formed under the same conditions as the second embodiment. The second development toner did not mix into the first image, and the second image produced the reflection density of more than 1.4.

In this embodiment also, relatively large amounts of carrier were observed adhering between the lines in the high-frequency line image (in this embodiment 2 line-pairs/mm).

[Embodiment 6]

Figure 17:
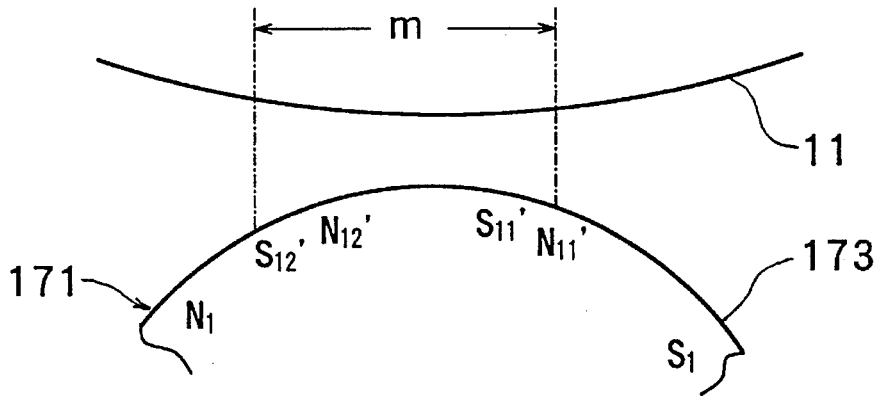
FIG. 17 is a schematic diagram showing the construction of the magnet roll used in the second development processor of Embodiment 6.

As shown in FIG. 17, the second development processor 17 of this embodiment incorporates a magnet roll 173 which has first development promotion magnetic poles S11', N11' installed in the upstream portion of the effective development area m and also second development promotion magnetic poles S12', N12' installed in the downstream portion of the effective development area m. An image was formed under the same condition as the first embodiment. There was no second development toner mixed into the first image, and the second image produced the reflection density of more than 1.4. As in the first embodiment, almost no carrier was found attached between lines in the high-frequency line image (in this embodiment 2 line-pairs/mm).

An image was also formed under the same conditions as the second embodiment. The second image has a still higher reflection density. [Embodiment 7]

Figure 18:
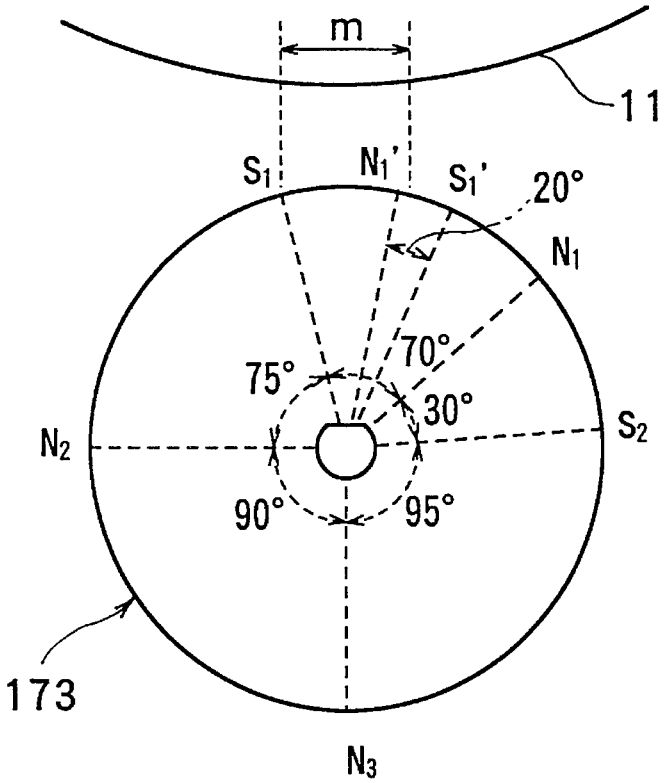
FIG. 18 is a schematic diagram showing the construction of the magnet roll used in the second development processor of Embodiment 7.

As shown in FIG. 18, the magnet roll 173 of this embodiment has a development magnetic pole pair for packing developer—N1 in the upstream side and S1 in the downstream side—and also has development promotion magnetic poles located in the upstream region of the effective development area m—S1' in the upstream side and N1' in the downstream side. The magnet roll 173 is further provided with a pickoff magnetic pole N2 to remove developer from the sleeve (not shown) after having moved past the effective development area m, a pickup magnetic pole N3 to attract developer to the sleeve and a trimming magnetic pole S2 to form a thin layer of developer over the sleeve.

Figure 19:
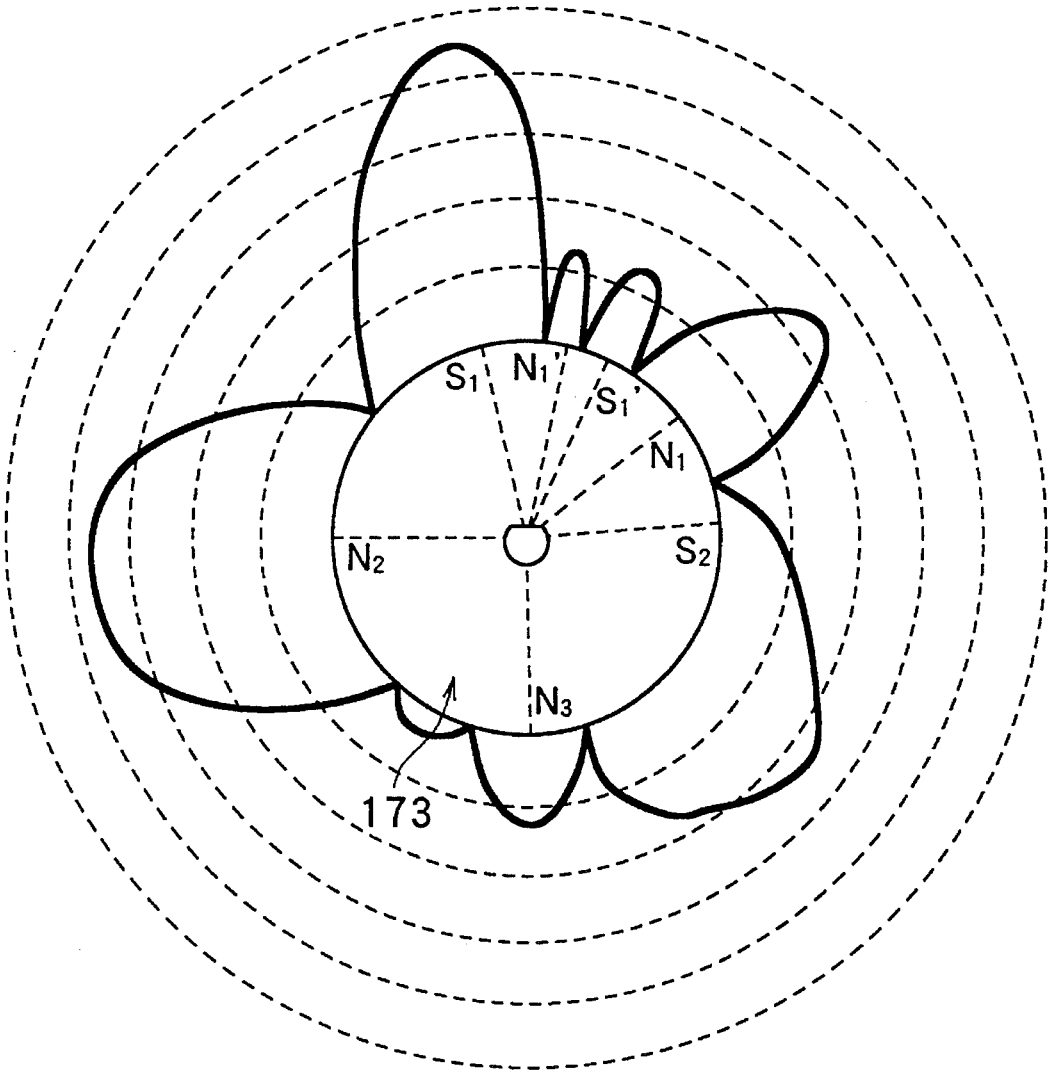
FIG. 19 is an example of radial component distribution of the magnetic force produced by the magnet roll of FIG. 18.

FIG. 19 shows radial components of magnetic force around the magnet roll 173 according to this invention. Under the same conditions as the first embodiment an image was formed. The experiment has found that no second development toner is mixed into the first image and that the second image has the reflection density of more than 1.2. Almost no carrier is found adhering between lines in the high-frequency line image (in this embodiment 2 line-pairs/mm).

In this embodiment, the second development processor is set with the bias conditions of 1.5 kHz, 1.0 kVp-p and −500 Vdc. With other conditions set equal to those of the first embodiment, the similar experiment was conducted. The result showed no second development toner mixing into the first image and the reflection density of the second image at more than 1.4. Almost no carrier was observed adhering between lines in the high-frequency line image (in this embodiment 2 line-pairs/mm), as in the first embodiment.

We claim:

1. In a development apparatus which includes a developer supporting body consisting of a rotatable non-magnetic sleeve and a magnet roll fixedly installed within the rotatable non-magnetic sleeve; a development method comprising the steps of:

supporting a two-component developer consisting of a toner and a magnetic carrier on the developer supporting body;

developing or making visible a latent image formed on a latent image supporting body from an effective development area on the developer supporting body with the two-component developer carried on the developer supporting body in a non-contact manner;

applying to the developer in the effective development area a horizontal magnetic field which is orientated in the circumferential direction of the developer supporting body, the effective development area facing the latent image supporting body; and applying a developer movement promotion magnetic field locally to a part of the effective development area on the developer supporting body to expel the developer from that part of the effective development area and slide chains of the carrier of the developer in a developer expelled region at least in the circumferential direction of the developer supporting body.

2. A development method according to claim 1, wherein the developer movement promotion magnetic field comprises vertical and horizontal magnetic field components acting in the radial and circumferential directions of the developer supporting body and is generated by a developer movement promotion magnetic pole pair.

3. A development method according to claim 1, wherein an AC bias is applied between the surface of the latent image supporting body and the non-magnetic sleeve.

4. A development apparatus comprising:

a developer supporting body including a rotatable non-magnetic sleeve and a magnet roll fixedly installed within the rotatable non-magnetic sleeve, the developer supporting body supporting thereon two-component developer consisting of a toner and a magnetic carrier;

a pair of horizontal field magnetic poles of opposite polarities installed in the magnet roll, the horizontal field magnetic pole pair applying to the developer in an effective development area on the developer supporting body a horizontal magnetic field that is oriented in the circumferential direction of the developer supporting body, the effective development area facing a latent image supporting body; and at least one pair of developer movement promotion magnetic poles of opposite polarities installed in the magnet roll at an intermediate position between the pair of the horizontal field magnetic poles, the developer movement promotion magnetic pole pair applying to a part of the effective development area on the developer supporting body so that the developer is expelled from that part of the effective development area and that chains of carrier of the developer in the developer expelled region are slid at least in the circumferential direction of the developer supporting body;

whereby a latent image on the latent image supporting body is developed or made visible in a non-contact manner by the two-component developer carried on the developer supporting body.

5. A development apparatus according to claim 4, wherein the developer movement promotion magnetic pole pair of opposite polarities influences a polarity changing area or neutral area in a vertical component of the field produced by the horizontal field magnetic pole pair to locally establish a developer expelled region at or around the neutral area on the developer supporting body, and wherein the developer movement promotion magnetic field applied to the neutral area has a peak value smaller than that of the vertical component produced by the horizontal field magnetic pole pair.

6. A development apparatus according to claim 4, wherein the developer movement promotion magnetic pole pair generates a developer movement promotion magnetic field including a vertical magnetic field component orientated in the radial direction of the developer supporting body and a peak value of the vertical magnetic field component is so set that the developer will not part from the developer supporting body.

7. A development apparatus according to claim 4, wherein the developer movement promotion magnetic pole pair generates a developer movement promotion magnetic field including an inverted horizontal magnetic field component orientated in a direction parallel to the circumferential direction of the developer supporting body and opposite to the horizontal magnetic field produced by the horizontal field magnetic pole pair.

8. A development apparatus according to claim 4, wherein the developer movement promotion magnetic pole pair generates a developer movement promotion magnetic field including an inverted horizontal magnetic field component orientated in a direction parallel to the circumferential direction of the developer supporting body and opposite to the horizontal magnetic field produced by the horizontal field magnetic pole pair, and wherein the inverted horizontal magnetic field component is applied only to the surface of the developer supporting body.

9. A development apparatus according to claim 4, wherein the developer movement promotion magnetic pole pair is installed on the developer supporting body in or around an upstream or downstream region of the effective development area to apply the developer movement promotion magnetic field to the upstream or downstream region of the effective development area.

10. A development apparatus according to claim 4, wherein a magnetic pole of the horizontal field magnetic pole pair on the rotating direction side of the non-magnetic sleeve is located in or around the downstream region of the effective development area.

11. A development apparatus according to claim 4, wherein a plurality of the developer movement promotion magnetic pole pairs are arranged to apply the developer movement promotion magnetic field to a plurality of locations in the effective development area on the developer supporting body.

12. A multicolor image forming apparatus in which a plurality of latent images are formed successively on a latent image supporting body, the latent images thus formed are developed or made visible successively by corresponding color toners, and the multicolor toner image formed on the latent image supporting body is then transferred to a transfer medium; said multicolor image forming apparatus uses a development apparatus to develop at least the second and subsequent images said apparatus comprising:

a developer supporting body including a rotatable non-magnetic sleeve and a magnet roll fixedly installed within the rotatable non-magnetic sleeve, the developer supporting body supporting thereon two-component developer consisting of a toner and a magnetic carrier;

a pair of horizontal field magnetic poles of opposite polarities installed in the magnet roll, the horizontal field magnetic pole pair applying to the developer in an effective development area on the developer supporting body a horizontal magnetic field that is oriented in the circumferential direction of the developer supporting body, the effective development area facing a latent image supporting body; and at least one pair of developer movement promotion magnetic poles of opposite polarities installed in the magnet roll at an intermediate position between the pair of the horizontal field magnetic poles, the developer movement promotion magnetic pole pair applying to a part of the effective development area on the developer supporting body so that the developer is expelled from that part of the effective development area and that chains of carrier of the developer in the developer expelled region are slid at least in the circumferential direction of the developer supporting body;

whereby a latent image on the latent image supporting body is developed or made visible in a non-contact manner by the two-component developer carried on the developer supporting body.

* * * * *